US005794320A

United States Patent [19]

Wernz et al.

[11] Patent Number: 5,794,320

[45] Date of Patent: Aug. 18, 1998

[54] CORE BULLET MANUFACTURING METHOD

[75] Inventors: Albert Wernz; Wolfgang Katzmaier, both of Oberndorf/Neckar, Germany

[73] Assignee: Heckler & Koch GmbH, Oberndorf/Neckar, Germany

[21] Appl. No.: 794,667

[22] Filed: Feb. 3, 1997

[30] Foreign Application Priority Data

Feb. 5, 1996 [DE] Germany ..... 196 04 061.2

[51] Int. Cl.[6] ..... B21K 21/06

[52] U.S. Cl. ..... 29/1.23; 102/514; 102/517

[58] Field of Search ..... 29/1.2, 1.23; 102/514, 102/515, 516, 517, 518, 519

[56] References Cited

U.S. PATENT DOCUMENTS

| | | | |
|---|---|---|---|
| 36,449 | 9/1862 | Boekel | 102/514 |
| 182,278 | 9/1876 | Hotchkiss | 29/1.2 |
| 388,496 | 8/1888 | Langfitt | 102/519 |
| 622,582 | 4/1899 | Wyatt | 102/519 |
| 644,361 | 2/1900 | Luciani | 102/519 |
| 776,056 | 11/1904 | Haase | 29/1.23 |
| 932,014 | 8/1909 | Haase | 102/519 |
| 1,767,308 | 6/1930 | Phillips . | |
| 2,303,449 | 12/1942 | Fleischmann . | |
| 3,599,573 | 8/1971 | Sliney . | |
| 3,720,170 | 3/1973 | Godfrey . | |
| 4,387,492 | 6/1983 | Inman . | |
| 4,708,063 | 11/1987 | Ladriere | 102/518 |
| 4,878,434 | 11/1989 | Sommet . | |

FOREIGN PATENT DOCUMENTS

| | | | |
|---|---|---|---|
| 0 279 732 | 8/1988 | European Pat. Off. . | |
| 336272 | 10/1903 | France . | |
| 496867 | 11/1919 | France . | |
| 800016 | 6/1936 | France . | |
| 2647201 | 11/1990 | France | 102/514 |
| 1017493 | 10/1957 | Germany | 102/514 |
| 1072515 | 12/1959 | Germany | 102/514 |
| 25 25 230 | 12/1976 | Germany . | |
| 754 | 4/1889 | Switzerland | 102/517 |
| 318865 | 3/1957 | Switzerland . | |
| 1 605 224 | 10/1984 | United Kingdom . | |
| 2 244 119 | 11/1991 | United Kingdom . | |

OTHER PUBLICATIONS

European Search Report Corresponding to EP 97 10 0478.

Derwent Abstract for DE 25 25 230.

*Primary Examiner*—David P. Bryant

*Attorney, Agent, or Firm*—Darby & Darby

[57] ABSTRACT

The invention relates to a highly accurate core bullet with a massive core (2) and a jacket (1) for a fire arm. The core (2) extends over the entire length of the bullet and has a diameter along at least the largest portion of its length which is significantly smaller than the outside diameter of the finished bullet (1). The invention also relates to a method for manufacturing such bullet by making a bullet blank (7) wherein the shank (4) and the most forward portion of the nose-end (3) are machined to finish size; by making the jacket blank (8) and attaching the same to the shank (4) of the core blank (7), wherein the jacket blank (8) has an oversized diameter and engages in a formfitting manner with the core blank (7) at a circular step (5) and, if necessary, at a shoulder at the rear head (6); and securing the bullet blank so made between turning centers and machining the final bullet contour with high precision centered with respect to the core.

4 Claims, 1 Drawing Sheet

CORE BULLET MANUFACTURING METHOD

FIELD OF THE INVENTION

The present invention relates to a core bullet with a massive core and an jacket for use in handguns.

BACKGROUND OF THE INVENTION

A bullet of this type is known and is intended to be fired particularly by machine guns, sharpshooter rifles, anti-tank rocket launchers and the like, with the core intended to have an armor-piercing effect. In order to prevent the core from slipping off the target, there is provided a soft, nose-end with an jacket. During manufacturing, the finished sized core is enclosed in a pressing operation first with a lead sheath and subsequently with a thin jacket for guiding purposes. These conventional cores are typically inserted from the rear, but sometimes also from the front as described on German Patent 2 05 734 (Krupp). Further bullets are described in German Patents 2 11 778 (Witkowitzer) and 40 16 051 (Rheinmetall), as well as in German Laid Open Publication DE 40 24 543 A 1 (Diehl) and DE 30 23 220 A1 (Earl).

It is also known to provide a precision bullet—for example, for precision rifles for achieving better long-range and penetrating power at large distances—with a core made of a heavy metal. In this case, the heavy metal core occupies the largest possible volume in the bullet in order to achieve a high cross-sectional load. The bullet should hereby become heavy enough—especially if the materials used for the jacket have a relatively low specific density—without exceeding the length/diameter ratio of 5:1 which is required for stability.

It is therefore an object of the invention to improve the core bullet described above so that its efficiency is improved.

SUMMARY OF THE INVENTION

This objective is attained in that the core of a bullet of the aforementioned type extends over the entire length of the bullet, wherein its diameter along at least the largest portion of its length is smaller, preferably significantly smaller than the outside diameter of the jacket.

The bullet of the invention differs from the known bullet in that it does not include an additional soft nose-end for preventing it from slipping off the target, and the bullet of the invention preferably also differs from the known precision bullet in that the diameter of the core is not as large as possible, but rather significantly smaller.

Accordingly the bullet of the invention actually forms a slender penetrator which achieves an extremely high cross-sectional load at the target due to its considerable length and its large mass, and consequently has a large armor-piercing effect. The bullet of the invention therefore penetrates like armor in an advantageous way.

Also, the accuracy of impact and the bullet energy over long distances are reliable due to the large total cross-sectional load.

The diameter of the core over most of its length is only a fraction of the diameter of the entire bullet. However, there is no lead sheath disposed between the core and the cover, as is otherwise known from the state of the art. Thus, by eliminating the lead sheath, a layer which is prone to have inherent tolerances, the accuracy of firing is improve.

The jacket of the core bullet according to the invention, is significantly thicker than the jackets commonly used, and the jacket is positioned directly on the bullet core. Advantageously, the thickness of the core is only about [illegible] of the diameter of the entire bullet. Thus, the design of the thickness of the core causes an increasing penetration power.

In a conventional bullet with a lead sheath, the lead sheath does not center the core with the required precision. In addition, the material of the lead sheath is never completely homogeneous. However, the bullet of the invention, the lead sheath is obviated and consequently also the inaccuracies resulting therefrom. The bullet of the invention is therefore particularly suited for being fired from precision weapons since it can be manufactured centered with very high precision.

It may also be feasible for the jacket to extend to the nose-end of the bullet. However, it is advantageous that the core itself forms the nose-end of the bullet, i.e. the core itself is exposed, and that the jacket extends only over a portion of the bullet core, when viewed from the rear head. The outside surface of the nose-end is therefore formed by the outside surface of the bullet core. If the core is made of hard metal, then the nose-end of the bullet will not be deformed inside the weapon even if it is subjected to a considerable stress in the loading mechanism of the weapon. The geometry of the nose-end of the bullet which is of particular importance for the accuracy of the trajectory, is consequently—in contrast to a bullet having a full jacket—unchanged from one bullet to the next. As a result, bullet-dependent scattering effects are reduced even further.

It has proven to be particularly advantageous for the jacket to extend only over about ¾ of the length of the core.

An advantageous form for the core is basically a pointed cylindrical rod. Preferably, however, the diameter of the rear portion of the nose-end formed by the core is larger than the diameter of the rearwardly formed shank of the core, thereby creating a circular step in the direction of the shank.

The jacket is seated on the circular step and its outer surface transitions smoothly into the nose-end of the core. In this way, an optically and geometrically perfect transition from the jacket to the core is formed. The jacket is hereby also prevented from becoming too thin which would occur if the jacket transitions continuously into a smooth core surface, which would in turn affect the mechanical strength.

The circular step also provides for the feasibility of including a guide element which can be fixedly secured along the longitudinal direction of the bullet, especially if the shank of the core is tapered towards the circular step. In this case, the core forms a kind of circular notch adapted for form-fitting engagement with a guide element.

The rear head section of the shank is preferably provided with a shoulder and has a diameter which is smaller than the diameter of the main section of the shank. It is then possible to attach a propellant-containing guide element rearwardly engaging the core in formfitting manner and capable of providing propulsion forces for the bullet core.

The aforementioned guide elements may be formed independent of the jacket. Preferably, however, the core is undercut by the jacket at the circular step and at the shoulder at the rear head. The jacket is hereby prevented from sliding off the bullet core.

Particularly suitable as a material for the core is a material which provides the core with a density from about 14 $kg/dm^3$ (sintered hard metal) to about 19 $kg/dm^3$ (tungsten) The hardness of the metal is here less important, and hard as well as soft metals are acceptable.

Since the core is exposed at the nose-end, toxic materials, such as uranium alloys, and strongly oxidizing materials can only be considered if a thin and durable protective coating can be applied to the core, for example a galvanic coating.

In general, the core and jacket may be fabricated from a large number of materials, depending on the intended use of the bullet of the invention. As an example, it may be advantageous to manufacture the core from ceramic or special materials, light alloys and the like. Particularly suited for the jacket is tombac.

The invention not only relates to a core bullet, but also to a method for making the core bullet. This is accomplished by making a bullet blank where the shank and the most forward portion of the nose-end are machined to finish size, preferably by grinding, and the remainder of the nose-end is made oversized; further, by the jacket blank and attaching the same to the shank of the core blank, with the jacket blank having an oversized diameter and engaging in a formfitting manner with the circular step and, if necessary, with the shoulder at the rear head; and securing the bullet blank so made between turning centers and machining the final bullet contour.

The finished outside contour is attained by clamping the core and by machining the same in a lathe. This accomplishes that the rotational axis of the finished bullet coincides exactly with the clamping axis of the core and that the bullet contour can be manufactured with the desired precision.

The core blank may, for example, be manufactured by any conventional manufacturing method. It is, however, particularly advantageous if a piece of material intended to be machined into the bullet blank is provided at its front face with a center point and at its rear head with a center hole before being clamped between turning centers and machined.

As a result, the core has an axis of rotation which coincides with the clamping axis and—according to the method of the invention-also with the longitudinal axis of the finished bullet axis.

The jacket blank may be either manufactured separately from the core or may the applied directly to the bullet core.

The separately machined jacket blank is preferably pushed onto the shank of the core blank and then plastically deformed radially in an inward direction.

Alternately, the material which later becomes the Jacket, is applied to the core blank by composite-casting, spray-coating, sintering, casting, evaporation, galvanic application or the like, until an oversize is achieved.

In any event, both the entire jacket blank and the core blank in the region where the nose-end of the bullet is exposed, are initially manufactured oversized and in a final step cut concentrically to the finish size as a unit, thereby not only providing a particularly high dimensional accuracy, but also a completely smooth and step-free transition between the noseend of the bullet and the jacket.

Which of the methods listed above for making the jacket blank will finally be preferred, depends primarily of the desired jacket material; plastic will be preferably spray-coated onto the shank, whereas a tombac or aluminum jacket will be prepared separately as preforms and then joined with the shank.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

Figure 1:
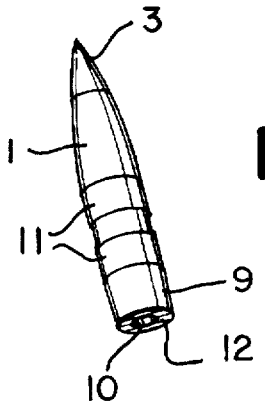
FIG. 1 is a perspective view of a core bullet according to the invention, approximately in actual size.

Throughout the drawing, identical reference numbers are used for identical elements or for elements having the same functionality. If one of the elements is not shown in FIG. 1 or does not have a reference number, reference is made to FIG. 2 and FIG. 3, respectively.

The illustrated bullet comprising a core 2 and a jacket 1 is formed as a relatively large bullet having a nose-end and a conical rear head, and is designed to be fired from a barrel provided with a twist.

The illustrated relative dimensions are preferred, but not limiting; other relative dimensions may also be equally advantageous.

The finished bullet (FIG. 1 and the solid outlines in FIG. 2 and FIG. 3) comprises a nose-end 3 whose length forms a portion of the total length of the bullet; furthermore, a bullet body and a bullet rear head 9, which in combination represent another portion of the length of the bullet and are penetrated in the center by a core shank 4. The core shank 4 is substantially cylindrical and has an outside diameter which is smaller, e.g. ⅔, than the largest outside diameter of the bullet.

Figure 2:
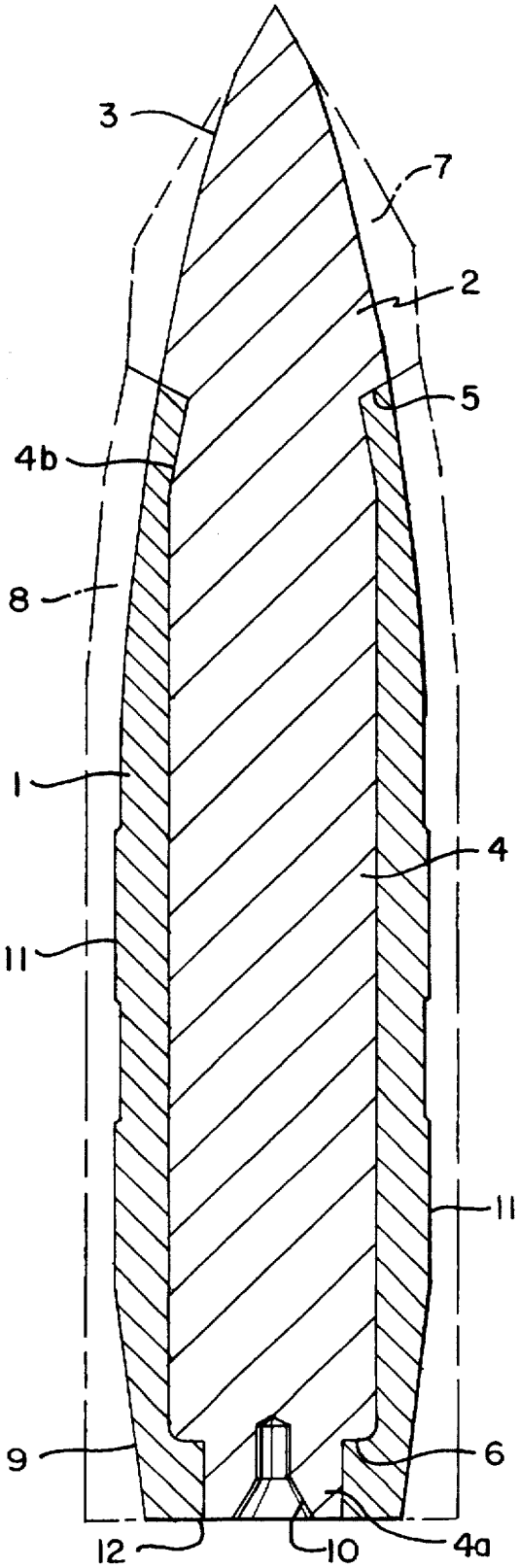
FIG. 2 is an enlarged vertical section of the finished bullet (solid line) and of the bullet blank (dot-dashed line), scale 5:1.

The shank 4 is surrounded by jacket 1 whose outside contour smoothly transitions into the outside contour of the nose-end 3. Furthermore, the outside of the jacket 1 may be smooth or may be provided with recesses, of which one—flanked at the front and the rear by guide zones 11—is shown in FIGS. 1 and 2.

Towards the rear head, the shank 4 extends past a shoulder 6 and terminates in a rear head section **4*a* having a diameter which is smaller than the diameter of the shank 4, for example ⅔ of the shank diameter. Towards the nose-end 3, the shank 4 terminates in a section 4*b* having a conical taper which merges with the nose-end 3 to form a single piece. The maximum diameter of the nose-end 3 in this region is substantially larger than the diameter of the shank 4, so that the rearward portion of the nose-end 3 projects outward from the shank, thereby forming a circular step 5. The end face of the nose-end 3 facing the tapered shank section 4*b* forms a very shallow conical surface. In an axial longitudinal section of the bullet, the angle between the contour of the conically tapered shank section 4*b* and the adjacent flat conical surface of the nose-end 3** is preferably approximately 90°.

The jacket 1 fits closely with the outside surface of the shank 4 and thus engages in a form-fitting manner with both the tapered shank section **4*b* behind the circular step 5 and the shaft section 4*a* at the rear head. Herein, the head surface 12 of the bullet forms a flat round end face whose ring-shaped outer area is formed by the jacket 1 and whose inner area is formed by the shank 4 of the core 2. A center hole 10** is located within the inner area.

At the most forward end of the nose-end 3, the core 2 is formed as a pointed nose cone.

During manufacturing of the bullet, a core blank 7 having the dot-dashed contour of the nose-end 3 shown in FIG. 2, is made first, wherein the shank 4 with the circular step 5, the tapered section 4*b*, the shoulder 6 and the section 4*a* at the rear head are already manufactured to the finished size.

The nose cone of the core blank 7 is extended rearwardly only in the region of the nose-end 3 where it transitions into a cylindrical section whose outside diameter is larger than the largest outside diameter of the core 2 after finish machining. The cylindrical section ends at the outwardly projecting circular step 5.

The head face of the core blank 7 is provided with the center hole 10.

During manufacturing of the core blank 7, for example from elongated round metal stock, first the nose cone and the central bore 10 are formed thereon, then the round stock is supported between the nose cone and the central bore 10 and machined further.

A jacket blank 8 is subsequently formed into a tubular sleeve which is then pushed over and pressed onto the shank in such a way that the material of the jacket blank 8 (dashed-double dotted line) encircles the circular step 5 at the shoulder 6 and seats tightly against the taper of the circular step 5 and the entire length of the outside of the shank.

The bullet blank so formed is now again supported between the center hole 10 and the nose cone and machined along an outside surface in such a way that the solid contour line is attained, thereby providing a smooth transition between nose-end 3 and jacket 1. If necessary, the head surface 12 is also finish machined.

As a result, the rotational axes of the finished bullet, the jacket 1 and the core 2 all coincide.

Figure 3:
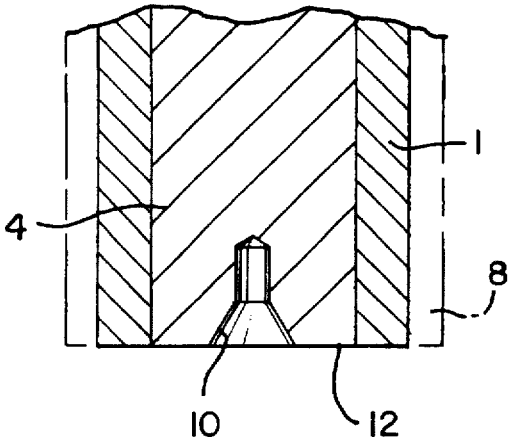
FIG. 3 is a truncated vertical section through a modification of an embodiment similar to FIG. 2.

Whereas the core 4 of the embodiment shown in FIG. 2 is provided at its rear head face with a shoulder 6, this shoulder 6 is missing from the core 4 in the embodiment of FIG. 3. There, the cylindrical core 4 extends to the rear head face or head of the bullet continuously, without a shoulder (head face 12).

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A method for making a core bullet, comprising the steps of a) forming a core bullet blank including a core shank and nose-end by machining the core shank to finishing size, machining a forward portion of the nose-end to finishing size, and machining a remainder of the nose-end maintaining an oversize, forming a circular undercut between the core shank and the remainder of the nose-end;

b) formfitting a jacket blank having an oversized outer diameter to the circular step and along the entire length of the core shank of the core bullet blank a; and c) securing the core bullet blank formed by a) and b) between turning centers and machining the outside of the core bullet blank and jacket blank such that the rotational axis of the core bullet blank coincides with the axis of the turning centers to form the final core bullet.

2. The method according to claim 1, further comprising the step of machining a center hole into the rear portion of the core shank.

3. The method according to claim 1, wherein the jacket blank is formfitted by plastically deforming in an inwardly directed radial manner.

4. The method according to claim 1, wherein the jacket blank is manufactured by one of composite casting, extrusion-coating, casting, spray-coating, evaporation, galvanic application and sintering.

* * * * *